United States Patent [19]

Gray et al.

[11] Patent Number: 4,951,317

[45] Date of Patent: Aug. 28, 1990

[54] ATHLETIC SLEEVE FOR PROTECTING LIMBS

[76] Inventors: Alfred H. Gray, 29361 Lower Valley Rd., Tehachapi, Calif. 93561; Rose A. Vaughn, Star Rte. 3, Box 4500-16, Bear Valley Springs, Calif. 93561

[21] Appl. No.: 335,855

[22] Filed: Apr. 10, 1989

[51] Int. Cl.[5] ..... A41D 13/08

[52] U.S. Cl. ..... 2/16; 2/22; 2/59

[58] Field of Search ..... 2/16, 22, 59, 61, 2, 2/24, 126, 170, DIG. 6; 128/77, 80 C

[56] References Cited

U.S. PATENT DOCUMENTS

| | | | |
|---|---|---|---|
| D. 239,220 | 3/1976 | Norman | 2/16 |
| D. 299,562 | 1/1989 | Lee | 2/16 |
| 1,638,206 | 8/1927 | Kelly | 2/61 |
| 1,708,144 | 4/1929 | Martin | 2/61 |
| 2,059,136 | 10/1936 | Moller | 2/59 |
| 2,326,422 | 8/1943 | Weisberger | 2/59 |
| 2,817,841 | 12/1957 | Bilecki | 2/22 |
| 3,074,405 | 1/1963 | Duensing | 2/22 |
| 3,256,882 | 6/1966 | Huber | 2/16 |
| 3,657,741 | 4/1972 | Blanco | 2/59 |
| 3,879,763 | 4/1975 | Smith | 2/59 |
| 4,099,269 | 7/1978 | Porner | 2/16 |
| 4,193,134 | 3/1980 | Hanrahan | 2/16 |
| 4,198,708 | 4/1980 | Fugere | 2/16 |
| 4,287,608 | 9/1981 | Meyer | 2/16 |
| 4,843,645 | 7/1989 | White | 2/59 |
| 4,856,112 | 8/1989 | Effle | 2/16 |

FOREIGN PATENT DOCUMENTS

| | | | |
|---|---|---|---|
| 2028141 | 1/1972 | Fed. Rep. of Germany | 2/22 |
| 128715 | 12/1927 | Switzerland | 2/59 |
| 219125 | 5/1942 | Switzerland | 2/22 |
| 6472 | of 1885 | United Kingdom | 2/59 |
| 277696 | 2/1927 | United Kingdom | 2/59 |
| 404651 | 1/1934 | United Kingdom | 2/59 |

*Primary Examiner*—Werner H. Schroeder
*Assistant Examiner*—Diana L. Biefeld
*Attorney, Agent, or Firm*—I. Michael Bak-Boychuk

[57] ABSTRACT

This invention relates to an article of clothing which can be worn by athletes to protect their arm muscles, or lower leg muscles, from the damaging affects of cold air or cold wind. This pull on and off sleeve, helps to prevent muscles from tightening or cramping, by eliminating exposure to cold air and wind. This invention does not press upon arm or leg muscles, or restrict elbow motion in any way. The athletic sleeve, which can be removed in less than one second, is so small that it can be carried in any pocket.

2 Claims, 1 Drawing Sheet

ATHLETIC SLEEVE FOR PROTECTING LIMBS

BACKGROUND OF INVENTION

Heretofore most conventional, weather protective apparel for athletes has been primarily designed with the objective of protecting the entire body form the waist up to the neck, or from the waist down to the ankle, from the damaging affects of cold air and wind. Weather protective apparel such as jackets, sweaters, warm up suits, and pants, tend to press upon limb muscles and elbows, thus restricting muscle, as well as elbow, activity. In addition, most of this conventional clothing is bulky, thus creating unwanted resistance to the air. Furthermore, conventional clothing cannot be put on, or removed instantly. Nor is such apparel portable enough to carry in one's pocket so that it can be put on, or removed and stored, in a pocket as the need Throwers need protective apparel that will keep their throwing arm from tightening up, while they are engaged in the process of throwing, which will not impede the act of throwing. Racquet players need arm protective apparel that will allow them to engage in competition, and will keep their hitting arm from tightening up, while not impeding their ability to compete. They need some limb protective apparel that can be put on, and removed in an instant. And they need to be able to keep this apparel with them while they are competing. Runners and cyclists need to be able to function with some sort of apparel which will not impact their activities, while protecting their lower legs from the cold and the wind. They need protective apparel that they can remove in an instant so that when weather conditions improve, or their muscles are sufficiently warm, they can discard their protective gear without having to slow down or stop. And they need to be able to carry this device with them. Athletes such as tennis players, discus throwers, javelin throwers, shot putters and baseball pitchers, normally wear jackets, warm up suits, long sleeves sweaters etc. to protect their limbs from the detrimental effects of cold air and cold wind. This conventional clothing has many disadvantages. The first disadvantage is that it is either heavy or bulky, and tends to bind, and restrict physical movement. The second disadvantage of wearing conventional weather protective clothing is that it creates additional wind resistance and wind drag, thus reducing the athletic ability to perform at maximum potential. The third disadvantage is that such clothing can cause an excessive accumulation of heat which is detrimental to an athlete's performance. While conventional weather protective clothing does protect arms and legs from cold air and wind, the rest of the body may suffer from an excessive build of body heat and sweat. The fourth disadvantage is that conventional weather protective clothing takes a lot of time to put on, or take off. A fifth disadvantage of conventional protective clothing is that it is not portable by virtue of the fact that its is too large and bulky to be stored on an athlete's body during competition. That means that an athlete must be able to stop competing long enough to either retrieve his protective clothing, in order to put it on, or store his protective clothing after it has been removed. Ballet dancers wear a lower leg, or anklet, type of sleeve which is made of either cotton or wool. But this apparel is not readily removable and cannot be taken off while the athlete is engaging in athletic activity. This anklet does not provide protection against the wind, and it is too bulky to carry around in a pocket.

SUMMARY OF INVENTION

In our invention we have provided apparel for athletes which consists of a sleeve, one for the arm and one for the lower leg, from the knee to the ankle, which protect these limbs from cold air and wind. The athletic sleeve does not interfere with an athlete's performance because the protected limb is not inhibited in any way. The loose sleeve, which is much longer and wider than the protected limb, does not press against muscles, nor does it restrict muscle, limb or elbow activity. The sleeve does not prevent the escape of body heat from any other part of the body. And, since the sleeve weighs less than one ounce, and covers only a small part of the body, wind drag is reduced substantially. When the athletic sleeve is compressed, it occupies less than four cubic inches. As a result, it can be stored in a tennis player's pockets, or in the waist band of a runner's track shorts. The arm sleeve model can be put on, and removed, with one hand in less than one second while the leg model can be put on in less than five seconds, and removed with one hand in less than one second. This provides runners and cyclists with the ability to function without interruption when removing the leg model.

One object of this invention is to provide weather protective apparel which is designed to protect only the arms and lower legs, from the knee to the ankle, of athletes from the disabling effects of cold air and cold wind.

Another object of this invention is to provide weather protective apparel for the arms and lower legs, which does not interfere with muscle, limb or joint movement.

A further object of this invention is to provide portability so that the protective apparel can be stored in an athletes's pockets.

A yet further object of this invention is to provide weather protective apparel which can be put on, or removed, easier and quicker than conventional, weather protective clothing.

Other objectives of this invention include reducing the amount of wind drag and wind resistance, experienced by athletes when wearing conventional weather protective clothing, as well as allowing heat to escape from those parts of the body which are exposed; by providing protective apparel which covers only the limbs, compared to jackets and sweaters which cover the entire trunk of the body, and warm up pants which cover the body from the waist to the ankle.

Yet another objective is that the athletic sleeve can be worn to protect the arms from cold air and wind by the following athletes: tennis plaYers, platform tennis players, racquetball players, baseball players, outdoor basketball players, football players, shot putters, discus throwers, javelin throwers, runners, rowers, cyclists and any other athlete whose bare arms are exposed to the cold or the wind.

Yet still another objective is to provide leg models that can be worn to protect the lower legs from cold air and wind of runners, rowers, cyclists and any other athlete whose bare legs are exposed to the cold or the wind.

DESCRIPTION OF THE PREFERRED EMBODIMENT

Figure 1:
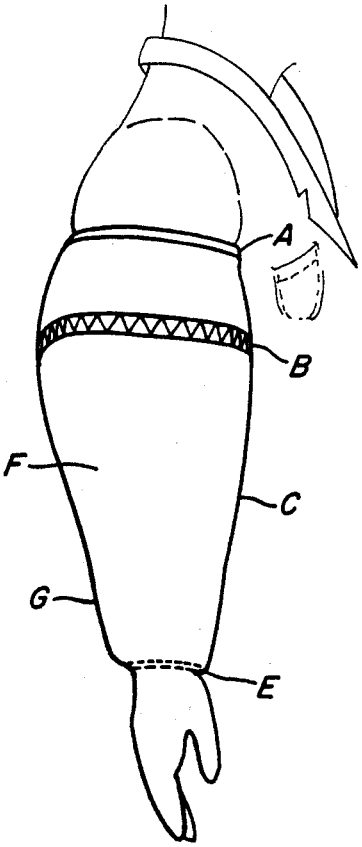
FIG. 1 shows sameness side of the Arm Model.

The upper arm opening, A in FIG. 1, fits snugly around the upper arm to prevent the athletic sleeve, F in FIG. 1, from slipping downwards. This is achieved by sewing an elastic band, M in FIG. 2, into the upper arm opening to hold it in place. The circumference of the upper arm opening, A in FIG. 1, and the length and strength of the elastic material, is selected to accommodate the upper arm of most athletes. The circumference of the upper arm opening, A in FIG. 1, is bigger than the circumference of the wrist opening, E in FIG. 1, in order to accommodate upper arms which are bigger than wrists.

The upper arm opening of the sleeve, A in FIG. 1, is identified by two bands of colored fabric, B in FIG. 1. These color bands help to reduce the amount of time necessary to put the sleeve on by providing a highly visible indication of which end to put on first, thus eliminating the need to visually examine each opening in order to determine which end of the athletic sleeve is wider.

The wrist opening, E in FIG. 1, fits snugly around the wrist to prevent the lower end of the sleeve from slipping upwards. This is achieved by sewing an elastic band into the wrist opening. N in FIG. 2, to hold it in place. The circumference of the wrist opening, and the length and strength of the elastic material, is selected to accommodate the wrist of most athletes. The circumference of the wrist opening, E in FIG. 1, is not as great as the circumference of the upper arm opening, A in FIG. 1, in order to accommodate wrists, which are smaller than upper arms.

Figure 2:
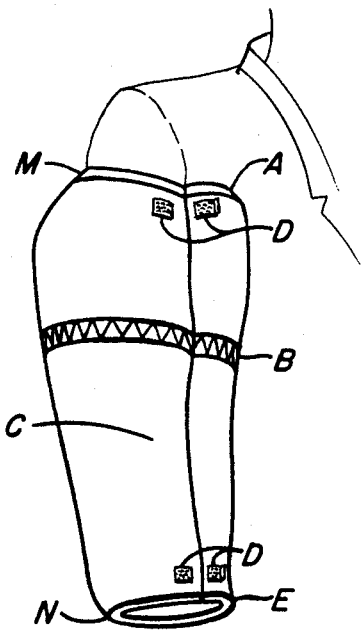
FIG. 2 shows seam side view of the Arm Model.
Figure 3:
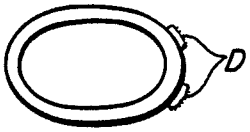
FIG. 3 shows disengaged Velcro tabs of the Arm Model.
Figure 4:
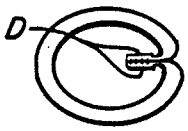
FIG. 4 shows overlapping Velcro tabs in the Arm model.

There are two sets of hook and pile, or Velcro, tabs, D in FIG. 2. One set of tabs is sewn close to the wrist opening, E in FIG. 2. The other set of tabs is sewn close to the upper arm opening. A in FIG. 2. One tab is sewn on each side of the seam, C in FIG. 2, near each opening. These tabs provide a means of reducing the circumference of the sleeve openings. When the sleeve is being worn, the circumference of each sleeve opening can be reduced by pinching these tabs together with the thumb and forefinger of one hand. Many materials can be used to reduce the circumference of the openings including string, snaps and buttons but Velcro was selected because of its adhesion characteristics which provides a faster and easier way to adjust the size of the openings then the other alternatives. In addition, the length of the Velcro tabs is sufficient to provide the athlete with the ability to reduce the circumference of the sleeve openings by increments. This is achieved by partially overlapping the tabs, or completely overlapping the tabs, D in FIG. 4. These Velcro tabs provide a method of reducing the sleeve opening from slightly more than one inch, to more than two inches.

The tapered sleeve, F in FIG. 1, can be made of almost any material including cotton, wool, rayon, orlon, dacron, nylon, polyester or any combination of these materials. Nylon was selected because of its lightness, flexibility and capacity to resist the penetration of wind. The length of the tapered sleeve is long enough, and width of the tapered sleeve is wide enough, to prevent the sleeve from pressing on muscles, restricting muscle activity, or interfering with limb and elbow mobility. The purpose of the taper is to reduce wind drag by eliminating excess material. In addition, the length of side G, in FIG. 1, is longer than the length of side 0, in FIG. 1, which is the seam of the sleeve. The seam side of the sleeve is worn on the inside of the arm so that the longer side of the sleeve, G in FIG. 2, is adjacent to the athlete's elbow. This feature allows the sleeve to accommodate increases in arm coverage requirements, which occur when the elbow is fully bent, without binding the elbow or restricting muscle activity.

Figure 5:
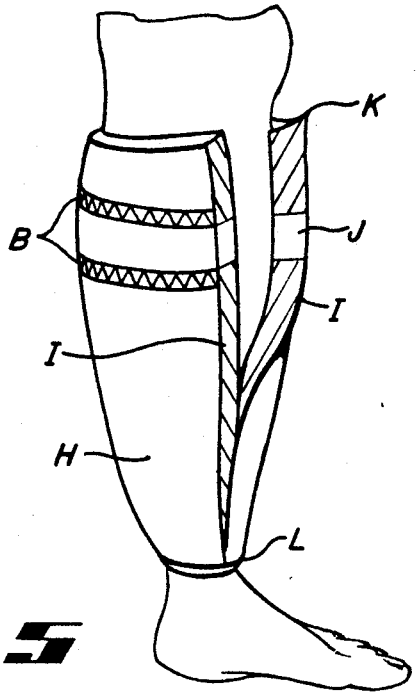
FIG. 5 shows disengaged seam view of the Leg model.

With the exception of the sides, which are of equal length, and the absence of Velcro tabs, the only difference between the leg model, H in FIG. 5, and the arm model, F in FIG. 1, is that the seam in the leg model, I in FIG. 5, is not sewn. The seam in the leg model is composed of mating Velcro strips which provide the athlete with the ability to remove this athletic sleeve, with one hand, in a small fraction of one second, as described in the following paragraph.

Figure 6:
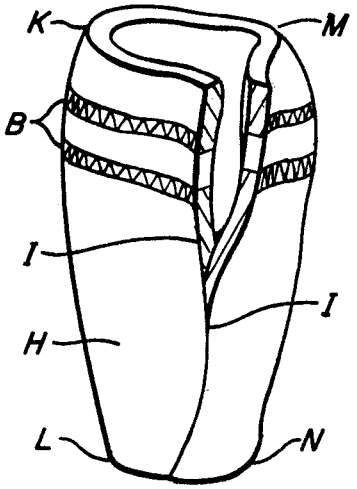
FIG. 6 shows closing of Velcro seam in the Leg Model

There is a gap in each of the mating Velcro strips, J in FIG. 5, which is located between the two colored bands, B in FIG. 5, which identify the upper end of the leg model. The athlete need only pinch this area, between the thumb and forefinger, and jerk upwards, in order to remove the sleeve from the leg. The rapid hand motion is sufficient to disengage the Velcro seam. This design provides the athlete with the ability to remove the sleeve, even while running or cycling, without having to either stop or slow down. If the leg model is pulled off in his way, it can be reassembled by mating the Velcro strips, 1 in FIG. 6 back together to re-establish the seam.

The upper leg opening, K in FIG. 5, fits snugly around the upper calf to prevent the athletic sleeve, H in FIG. 5, from slipping downwards. This is achieved by sewing an elastic band, M in FIG. 6, into the upper leg opening to hold it in place. The circumference of the upper arm opening, K in FIG. 5, and the length and strength of the elastic material, is selected to accommodate the upper leg of most athletes. The circumference of the upper leg opening, K in FIG. 5, is bigger than the circumference of the ankle opening, L in FIG. 5, in order to accommodate the upper leg which is bigger than the ankle.

The upper leg opening of the sleeve, K in FIG. 5, is identified by two bands of colored fabric, B in FIG. 5. These color bands help to reduce the amount of time necessary to put the sleeve on by providing a highly visible indication of which end to put on first thus eliminating the need to visually examine each opening in order to determine which end of the athletic sleeve is wider.

The ankle opening, L in FIG. 5, fits snugly around the ankle to prevent the lower end of the sleeve from slipping upwards. This is achieved by sewing an elastic band into the ankle opening, N in FIG. 6, to hold it in place. The circumference of the ankle opening, and the length and strength of the elastic material, is selected to accommodate the ankle of most athletes. The circumference of the ankle opening, L in FIG. 5, is not as wide as the circumference of the upper leg opening, K in FIG. 5, in order to accommodate ankles which are smaller than upper legs.

In this description of our preferred embodiment, we have not mentioned all of the attributes and adaptations of our invention. Also, we have not discussed all of the materials and configurations for which the possibilities for this invention exist. Therefore, all of these other attributes, adaptations, configurations and material selections, are fully included here in.

We claim:

1. An athletic arm sleeve conformed for rapid mounting and removal from the forearm and elbow of a person, comprising:

a generally frusto conical fabric enclosure defined by an upper and a lower edge, said upper edge being larger in circumference than said lower edge;

a resilient, elastomeric band fixed to said enclosure proximate said upper edge;

a first set of mating hook and pile fastener tabs fixed to the exterior of said enclosure proximate said upper edge, said tabs of said first set being spaced relative each other whereby the circumference of said enclosure is shortened by folding said fabric to effect mating engagement of said first set of tabs, to expand said elastomeric band;

a second set of mating hook and pile fastener tabs fixed to the exterior of said enclosure proximate said lower edge, said tabs of said second set being spaced relative each other whereby the circumference of said enclosure is shortened by folding said fabric to effect mating engagement of said second set of tabs; and a colored circumferential stripe fixed to the exterior of the enclosure proximate said upper edge for providing a visual indicating thereof and for providing an alignment index for the mating of said first set of tabs.

2. An athletic leg sleeve conformed for rapid mounting and removal from the lower leg portion of a person, comprising:

a generally rectangular fabric surface defined by an upper edge adjacent the knee of the wearer and a lower edge and a first and second lateral edge extending between said upper and lower edges;

a first hook and pile strip extending along said first lateral edge, said first strip including a first gap formed therein;

a second hook and pile strip extending along said second lateral edge, said second strip having a second gap formed therein, whereby the mating engagement of said first and second strips generally aligns said first and second gaps adjacent each other;

a pair of substantially parallel color bands fixed to said surface and extending between said first and second gap;

an elastomeric band fixed to said surface adjacent said upper edge; and said first and second gaps and said color bands being disposed on said surface proximate said upper edge and in substantial alignment with each other when worn on a leg.

* * * * *